US006290559B1

(12) United States Patent
Scott

(10) Patent No.: US 6,290,559 B1
(45) Date of Patent: Sep. 18, 2001

(54) APPARATUS FOR FASTENING OPEN HEEL FOOTWEAR, INCLUDING SWIMMING FINS

(76) Inventor: Edward Scott, 9 Whitefield Neuk Queensgate, Dunfermline (GB), KY12 0RL ( * ) Notice: Subject to any disclaimer, the term of this patent is extended or adjusted under 35 U.S.C. 154(b) by 0 days.

(21) Appl. No.: 09/297,767

(22) PCT Filed: Sep. 9, 1998

(86) PCT No.: PCT/GB98/02709

§ 371 Date: May 7, 1999

§ 102(e) Date: May 7, 1999

(87) PCT Pub. No.: WO99/12612

PCT Pub. Date: Mar. 18, 1999

(30) Foreign Application Priority Data

Sep. 10, 1997 (GB) ..... 9719089

(51) Int. Cl.[7] ..... A63B 31/08

(52) U.S. Cl. ..... 441/64

(58) Field of Search ..... 441/60–64; 36/103, 36/138, 105, 50.1; D21/806

(56) References Cited

U.S. PATENT DOCUMENTS 5,083,954 * 1/1992 Jacobs ..... 441/64
5,282,327 * 2/1994 Ogle ..... 36/138

FOREIGN PATENT DOCUMENTS

572853 * 12/1993 (EP) .

* cited by examiner

*Primary Examiner*—Ed Swinehart
(74) *Attorney, Agent, or Firm*—Fleshner & Kim, LLP

(57) ABSTRACT

Footwear, such as a swimming fin, is described with a mechanical clamp for fastening to a user's foot, the mechanical clamp being operable between a fastening position and a release position by the user's other foot.

8 Claims, 2 Drawing Sheets

APPARATUS FOR FASTENING OPEN HEEL FOOTWEAR, INCLUDING SWIMMING FINS

BACKGROUND OF THE INVENTION

The present invention comprises improved apparatus for the fastening or attachment of footwear such as may be used for various sporting activities, including skiing, underwater diving, swimming, fishing, snowboarding and so on. The invention finds a particular application in relation to swimming fins.

Swimming fins, also commonly referred to as "flippers", are generally provided with a large propulsion portion in the form of a flexible blade (the fin), which itself has an integral foot receiving area with open heel. Conventionally straps are provided which span the back of the open heel to secure the user's foot once located within the integral root receiving area.

In the present invention it is recognised that these straps, and particularly their need to be tied or buckled with the employment of the user's hands, are associated with several disadvantages. For example, divers may be required to carry heavy and cumbersome equipment, affecting their balance and manoeuvrability. Usually this equipment is adorned by the diver prior to the fins being worn. In order to put on the fins and fasten them to the diver's foot using straps or other fastening means heretofore known, the diver is required to rely on assistance from another person or to crouch down, probably with all or at least the majority of his own weight and the weight of his equipment on one leg. This difficulty must be considered not only in calm beach conditions, but also on rocks potentially buffeted by waves and or of slippery or hazardous surface from seaweed, barnacles and so on. Similar difficulties are encountered in boats where level and stable footings may be unavailable.

There have been many accidents, some even fatal, caused by divers slipping or otherwise losing their balance and it is apparent that the simple adorning of fins should not be a strenuous activity, particularly prior to diving where regular and calm breathing cycles are desired.

Typical fastening means known to the art may be examined in U.S. Pat. No. 5,545,067 and U.S. Pat. No. 4,795,384. In both these prior art publications the fastening means substantially comprises of a strap.

SUMMARY OF THE INVENTION

An object of the present invention is to provide an improved means for securing a person's foot in footwear, such as a swimming fin. A further object is to provide a means for securing a person's foot in footwear which may be easily fastened and released without or with minimal use of the person's hands. A further object of the present invention is to replace the need for straps, which require to be tied or clipped, with a mechanical clamp requiring no such tying during normal use.

According to the present invention there is provided footwear comprising a foot receiving portion having an open heel area and fastening means for securing a user's foot within the foot receiving portion characterised in that the means substantially comprises a mechanical clamp.

Preferably the clamp is operable between a first non-securing position whereat the clamp does not interfere or impede the access or removal of the user's foot to or from the foot receiving portion to a second securing position whereat the clamp presses against the heel portion of the user's foot such that the foot is retained or secured within the foot receiving portion.

The clamp may be biased to move toward the aforesaid second position whenever the clamp is not located in the aforesaid first position.

Advantageously the clamp may be operable between the aforesaid first and second positions by the use of the user's other foot.

Optionally, the footwear is a swimming fin.

BRIEF DESCRIPTION OF THE DRAWINGS

In order to provide a better understanding of the invention, embodiments will now be described, by way of example only, with reference to the accompanying Figures, in which.

DETAILED DESCRIPTION OF PREFERRED EMBODIMENTS

Figure 1A:
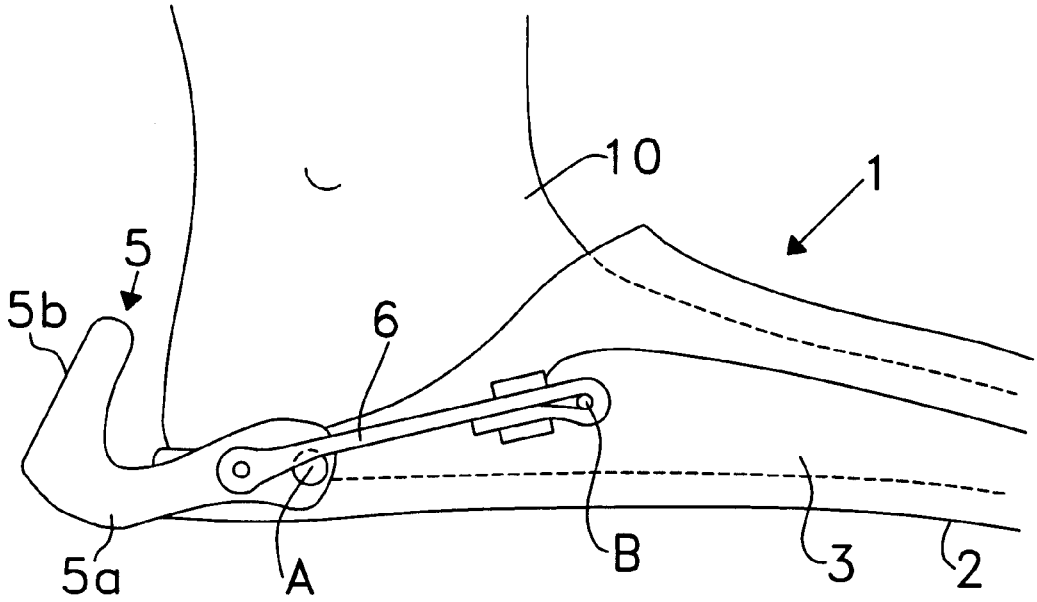
FIGS. 1*a* and 1*b* show side elevations of a swimming fin comprising a fastening clamp in accordance with the invention wherein the clamp is in a first non-securing position and a second securing position respectively.

Referring to the Figures, footwear generally referenced 1, is shown in the form of a swimming fin. The fin 1 is provided with a large blade 2 for assisting propulsion, the blade 2 incorporating a foot receiving portion 3. Access of a user's foot 10 is enabled through the open heel area 4.

Figure 1B:
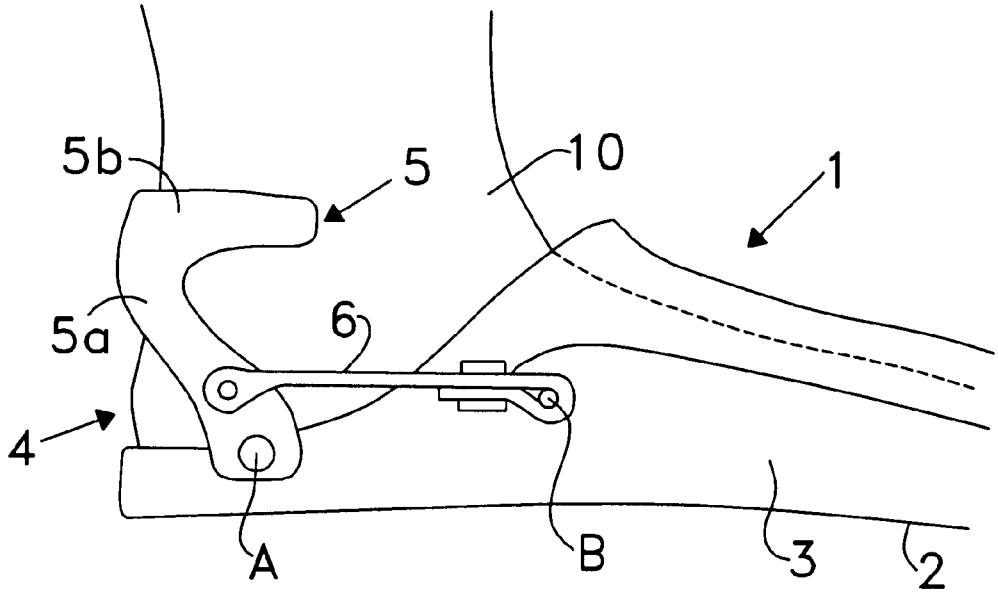

In the example embodiment illustrated in FIG. 1, a fastening means is formed as a rigid clamp 5. The clamp 5 is moveable between a first non-securing position (FIG. 1*a*) whereat the user's foot can gain unimpeded access or release into or out of the foot receiving portion 3 and a second securing or clamping position around the heel or archilles tendon of the user. In FIG. 1*b* the clamp 5 is shown in this second position.

The clamp 5 is of a generally "C" or "U" shape, having two arms 5*a* and a brace 5*b*. Each arm 5*a* is pivotally anchored at a respective point A. In the embodiment of FIG. 1 there is provided a rubber or elasticised spring 6 which biases the clamp 5 toward the second securing position when the clamp is not located in the first position. At the first position, the clamp 5 is in equilibrium. The spring 6 is held under tension and is linked between an anchor point B on the upper side of the fin 1 and anchor point C on the clamp arm 5*a*. A second spring (not shown) is provided in like manner but on the rear side of the fin when viewed from the perspective of FIG. 1.

In use, a user's foot is inserted into the foot receiving portion 3 via the open heel area 4 while the clamp 5 is in the first position shown in FIG. 1*a*. Notably, for such time as the clamp is in the first position, the spring 6 does not apply a moment about the pivot anchor point A, and thus although the spring is held under tension, the clamp 5 remains at equilibrium in the first position.

Once the user's foot is appropriately inserted into the receiving portion 3, the clamp 5 may be nudged upwardly, that is in a clockwise direction relative to FIG. 1, to such extent that the spring thereafter rotates the clamp 5 until the brace 5*b* locates behind the user's heel or archilles tendon. The fin is then appropriately fastened or secured on the user's foot. To remove the fin, the clamp 5 is released by pulling the clamp 5 away from the user's heel at the second position toward the first position.

Thus, the clamp fastening means may be operated simply by pushing, pulling and/or nudging the clamp 5 between its two respective operating positions. Most importantly, this may be done by the user's other foot, whether wearing a fin or not, and does not require to employ the user's hands or those of an assistant. No crouching or bending is needed, rendering the fastening means considerably advantageous over the known art, not only in terms of convenience but also in terms of safety.

The fastening apparatus of the embodiment illustrated in FIG. 1 can also include suitable means for adapting the tension of the spring to suit a particular user's foot size. This may be achieved by pinching the spring 6, for example, to reduce the stretch or elasticity of the spring 6.

Figure 2:
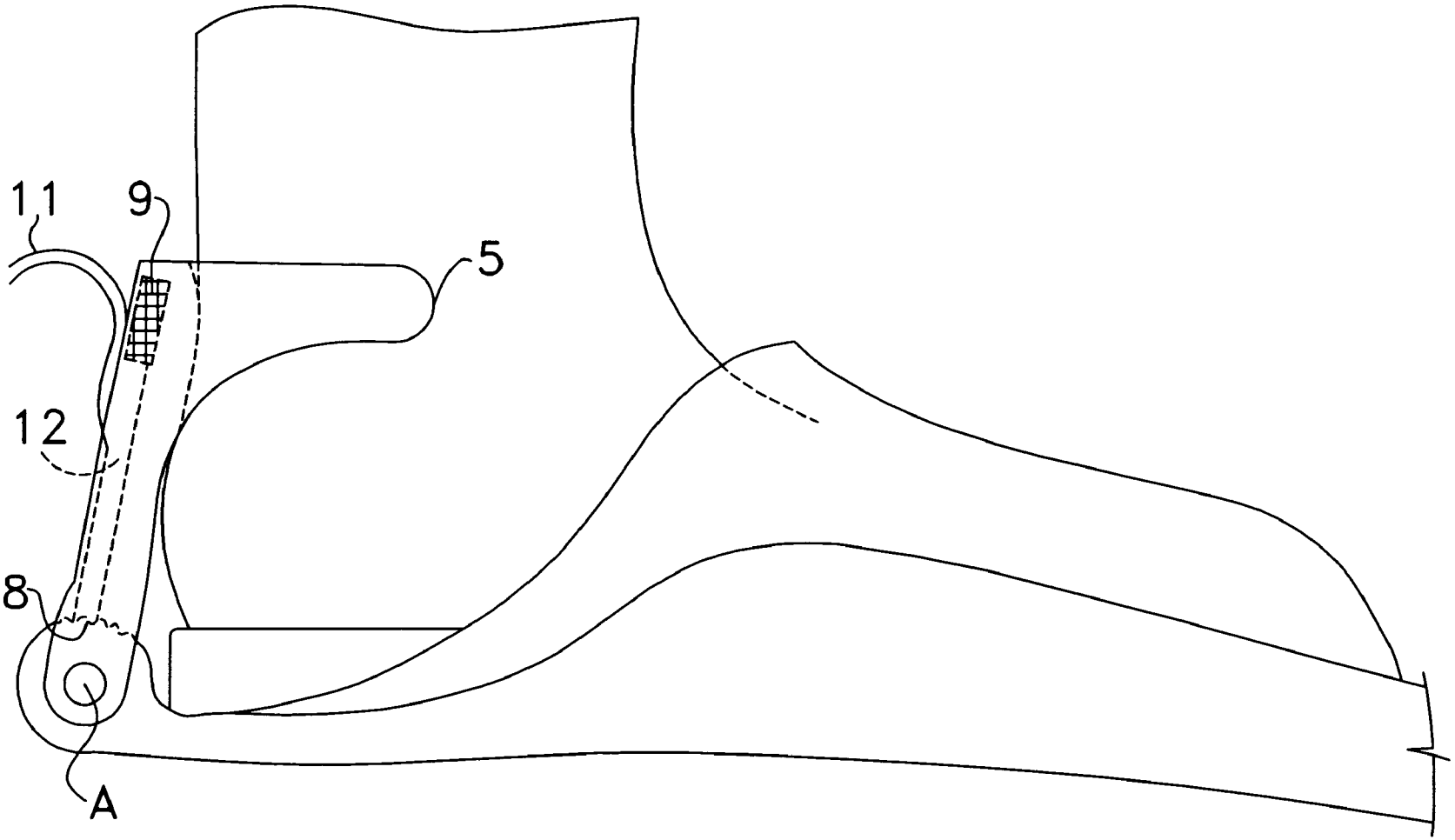
FIG. 2 is a side elevation of a swimming fin also comprising a fastening clamp in accordance with the invention but of alternative embodiment to that shown in FIG. 1.

In the embodiment of FIG. 2, the spring 6 is replaced by a ratchet mechanism generally described at 7 and comprising a toothed lock 8 at the pivotal anchor point A and a locking bar 12 held by a retaining spring 9 which engages with the lock 8 to prevent movement. A release clip 11 serves as a grip for disengaging the locking bar 12 when it is desired to move the clamp 5 from its present position to its alternate operable position. Again the clamp 5 is operable between a non-securing and securing position, its position being held stable by the ratchet mechanism 7.

It is recognised herein that this second embodiment of the invention, again given as an example only, may be less desirable than the first embodiment as the release of the locking bar may employ, albeit momentarily, the user's hands.

Nevertheless, in both of the described embodiments conventional straps are replaced by a clamp mechanism requiring little time and effort to operate. By this it is anticipated that the particular and recognised hazard of putting on fins, particularly while laden with heavy equipment, is mitigated to a great extent.

It is to be appreciated that notwithstanding the described embodiments relate to a swimming fin, the invention also may find application in respect of other footwear, including skiing, skating and skateboarding or snowboarding footwear. The invention may be beneficial where a user wears an inner and an outer boot, the outer boot incorporating the invention.

Similarly, references herein to "swimming fins" should not be deemed to limit the use of fins incorporating the invention to swimming in any narrow sense. Rather such swimming fins may be used in diving, swimming, paddling and so on.

Further modifications and improvements may be incorporated without departing from the scope of the invention herein intended.

What is claimed is:

1. Footwear comprising:

a foot receiving portion having an open heel area; and fastening means for securing a user's foot within the foot receiving portion, wherein the fastening means substantially comprises a mechanical clamp, and one or more mechanical tension links, and wherein the mechanical clamp is pivotally mounted and adapted to pivot between a first position and a second position such that in the first position the mechanical clamp is not encouraged by said one or more mechanical tension links to pivot toward the user's foot and is held clear of the user's foot, and in the second position the mechanical clamp is biased by said one or more mechanical tension links to pivot towards and press against the heel of the user's foot, such that the foot is retained or secured within the foot receiving portion.

2. Footwear as claimed in claim 1, wherein the clamp is operable between the aforesaid first and second positions by the use of the user's other foot.

3. Footwear as claimed in claim 1 consisting of a swimming fin.

4. Footwear as claimed in claim 1 wherein said fastening means is not associated with a lace, buckle or hook and loop fastener.

5. Footwear for attaching to a user's foot, comprising:

a foot receiving portion having an open heel area; and a mechanical clamp having a biasing member and operable between a non-securing position and a plurality of securing positions, wherein the mechanical clamp is pivotally mounted and in the non-securing position the mechanical clamp is not biased by the biasing member toward the user's foot allowing the user's foot to be inserted into and removed from the foot receiving portion and wherein when in one of the plurality of securing positions the mechanical clamp is baised by the biasing member to pivot towards a heel portion of the user's foot pressing against the heel portion of the user's foot such that the user's foot is secured within the foot receiving portion.

6. The footwear of claim 5, wherein no user adjustment is required to use different ones of the plurality of securing positions.

7. The footwear of claim 6, wherein the mechanical clamp comprises a U-shaped contact surface that is pressed against the heel portion of the user's foot under the biasing force of the biasing member.

8. The footwear of claim 6, wherein the footwear is a swimming fin.

* * * * *